US007441308B1

(12) United States Patent
Pappas

(10) Patent No.: US 7,441,308 B1
(45) Date of Patent: Oct. 28, 2008

(54) WATERTIGHT DOOR HINGE SUPPORT

(75) Inventor: Constantine V. Pappas, Philadelphia, PA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 107 days.

(21) Appl. No.: 11/169,257

(22) Filed: Jun. 23, 2005

(51) Int. Cl.
*E05D 11/00* (2006.01)

(52) U.S. Cl. ..... 16/273; 16/242; 16/248

(58) Field of Classification Search ..... 16/247, 16/248, 235, 273, 275, 242, 243, 233, 246, 16/360, 364, 382, 133; 114/116, 117
See application file for complete search history.

(56) References Cited

U.S. PATENT DOCUMENTS

| | | | | | |
|---|---|---|---|---|---|
| 3,592,257 | A | * | 7/1971 | Matyas | 160/186 |
| 3,921,225 | A | * | 11/1975 | Suska | 16/273 |
| 3,991,436 | A | * | 11/1976 | Nagase | 16/273 |
| 4,353,146 | A | * | 10/1982 | Brockhaus | 16/387 |
| 4,630,332 | A | * | 12/1986 | Bisbing | 16/273 |
| 5,075,928 | A | * | 12/1991 | Bobrowski | 16/273 |

FOREIGN PATENT DOCUMENTS

| | | | | |
|---|---|---|---|---|
| DE | 3641602 | A1 | * | 6/1988 |
| EP | 149492 | A2 | * | 7/1985 |
| GB | 2071201 | A | * | 9/1981 |
| GB | 2122679 | A | * | 1/1984 |
| GB | 2195958 | A | * | 4/1988 |

* cited by examiner

*Primary Examiner*—Robert J Sandy
*Assistant Examiner*—Ruth C Rodriguez
(74) *Attorney, Agent, or Firm*—Jacob Shuster; Dave Ghatt

(57) ABSTRACT

Watertight closure of an opening within a wall, under manually controlled displacement of a door panel, is enhanced by pivotal mounting of the door panel on the wall by vertically spaced hinge assemblies each of which is more readily assembled from a minimal number of components including upper and lower hinge pads fixed to the wall, a single hinge pin supported on the upper hinge pad and extending downwardly therefrom through the lower hinge pad and an end portion of a hinge blade fixed to the door panel. Flanged bushings are inserted into the upper and lower hinge pads through which the hinge pin extends. Also positioned within the end portion of the hinge blade through which the hinge pin extends is a flanged bushing having a horizontally elongated hole formed, therein through which the hinge pin extends so as to allow limited horizontal displacement thereof relative to the wall. The bottom flange of the hinge blade bushing is spaced by a pair of washers from the flange of the lower hinge pad bushing.

1 Claim, 2 Drawing Sheets

WATERTIGHT DOOR HINGE SUPPORT

STATEMENT OF GOVERNMENT INTEREST

The invention described herein may be manufactured and used by or for the Government of the United States of America for governmental purposes without the payment of any royalties thereon or therefore.

The present invention relates generally to watertight door panel hinges that are wear resistant and easy to install.

BACKGROUND OF THE INVENTION

Watertight doors made of steel or aluminum, utilized on U.S. Navy ships for example, are pivotally supported by yoke type hinge assemblies that allow the door panels to be pulled against a door frame knife-edge to compress a gasket for watertight security. Such watertight door hinge assemblies have not been able to withstand repeated open/close cycling operations for extended periods of time because of relatively rapid wear of brass components associated therewith, such as hinge pins, yoke pins and washers, causing chafing of the knife-edge at opposite sides of the door panels.

In an effort to deal with the foregoing door hinge problems, the brass components have been replaced with costly composite wear resistant materials for high-use doors, involving detailed and intricate installational problems.

It is therefore an important object of the present invention to provide for pivotal hinge support of watertight and airtight doors by use of less costly hinge assemblies that are more easy to install.

SUMMARY OF THE INVENTION

Each of the hinge assemblies, through which a watertight door panel is pivotally supported on a door wall, features a single hinge pin extending vertically through a hinge bushing positioned on a lower one of two hinge pads of the hinge assembly fixed to the door frame encircling an opening in the door wall to be closed by the door panel. The hinge pin extends downwardly from the upper one of the two hinge pads fixed to the door frame through a pin hole within another hinge blade bushing therein. A hinge blade fixed to the door panel also has a bushing therein which extends upwardly from a pair of spacer washers positioned therebelow on the lower one of the hinge pads by a flange portion of the lower hinge pad bushing. The pin hole within the door panel hinge blade bushing positioned between the upper and lower door frame hinge pads is horizontally elongated so as to allow horizontal displacement of the door panel hinge blade bushing relative to the hinge pin, thereby allowing the knife-edge at the door wall opening, to engage the door panel in its closed position.

BRIEF DESCRIPTION OF THE DRAWING

A more complete appreciation of the invention and many of its attendant advantages will be readily appreciated as the same becomes better understood by reference to the following detailed description when considered in connection with the accompanying drawing wherein.

DETAILED DESCRIPTION OF PREFERRED EMBODIMENT

Figure 1:
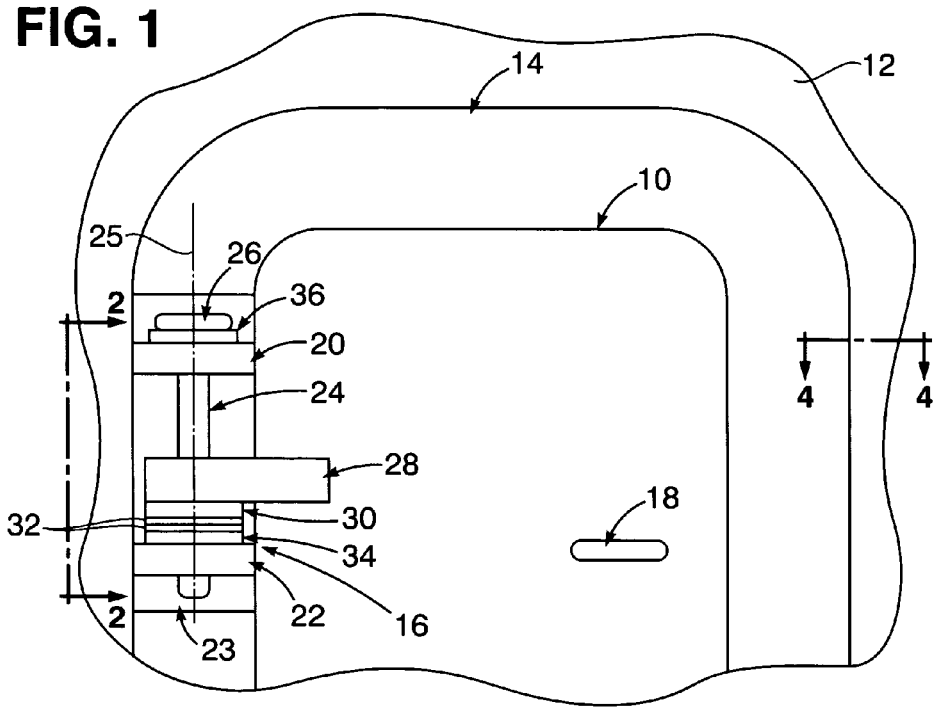
FIG. 1 is a partial front elevation view of a watertight door on a support wall with hinge assemblies associated therewith.
Figure 2:
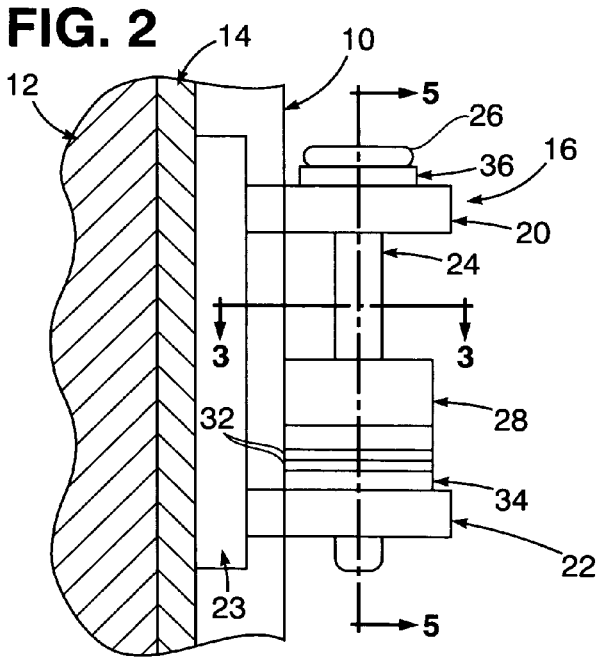
FIG. 2 is a partial section view taken substantially through a plane indicated by section line 2-2 in FIG. 1.
Figure 3:
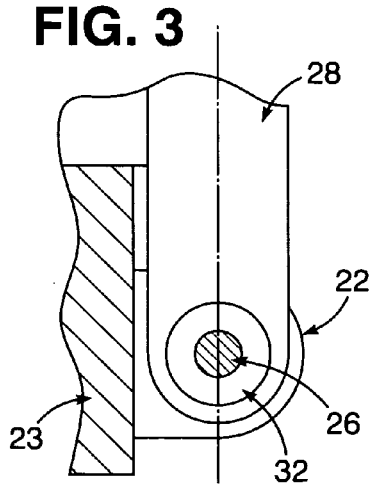
FIG. 3 is a partial section view taken substantially through a plane indicated by section line 3-3 in FIG. 2.

Referring now to the drawing in detail, FIG. 1 illustrates a watertight door panel 10 made of steel or aluminum positioned on a wall 12 over an opening formed therein surrounded by a door frame 14. The door panel 10 is pivotally mounted by a plurality of hinge assemblies 16 on the door frame 14, an upper one of which is shown in FIG. 1. The hinge assemblies 16 are vertically spaced from each other on one side portion of the door panel 10 opposite the other side portion thereof on which a door handle 18 is mounted.

Figure 4:
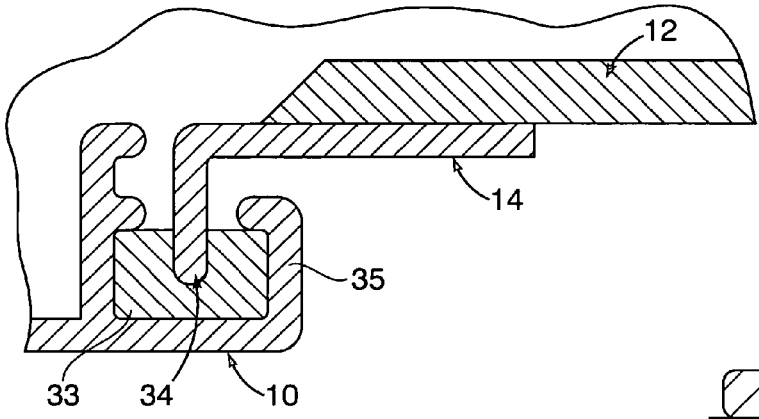
FIG. 4 is a partial section view taken substantially through a plane indicated by section line 4-4 in FIG. 1.

Each of the hinge assemblies 16 includes a pair of vertically spaced hinge pads 20 and 22 extending from a mount 23 fixed to the door frame 14. A single hinge pin 24 made of stainless steel extends vertically through the hinge pads 20 and 22 from a pin head 26 in abutment with the upper hinge pad 20. The hinge pin 24 having an axis 25 also extends through an end portion of a hinge blade 28 fixed to the door panel 10 having a flange bushing 30 therein. A pair of spacer washers 32 is positioned on the hinge pin 24 between the hinge blade bushing 30 and a flange bushing 34 within the lower hinge pad 22. A flange bushing 36 is also positioned on the hinge pin 24 below the pinhead 26 within the upper hinge pad 20. In the closed position of the door panel 10 as shown in FIGS. 1 and 4, a knife-edge 15 formed in the door frame 14 along the handle side portion of the door panel 10 has a gasket 33 fixed thereto in sliding contact within a channel formation 35 fixed to the door panel 10 so as to establish water tightness.

Figure 5:
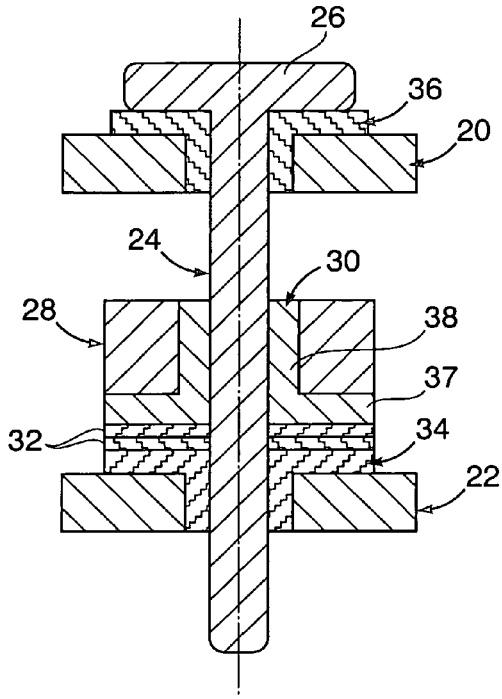
FIG. 5 is a section view taken substantially through a plane indicated by section line 5-5 in FIG. 2.
Figure 6:
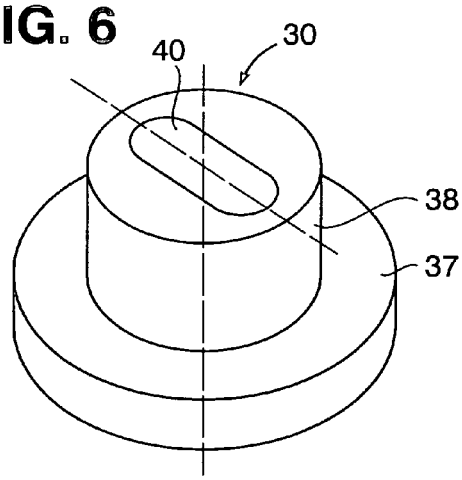
FIGS. 6 and 7 are perspective views of disassembled hinge blade and hinge pad bushing components associated with the hinge assembly shown in FIG. 1.
Figure 7:
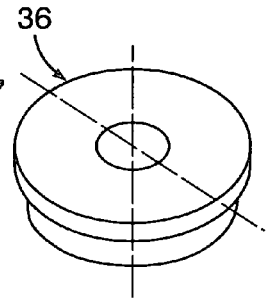

Referring now to FIGS. 1, 2, 5 and 6, the hinge blade bushing 30 has a circular flange portion 37 positioned above the lower hinge pad 22 and a cylindrical body portion 38 that extends, upwardly from the flange 37 within the hinge blade 28. An elongated slot hole 40 is formed in the hinge blade bushing 30 as shown in FIG. 6, dimensioned to slidably receive the hinge pin 24 therethrough, with the hinge blade bushing 30 slidable with respect to the hinge pin. This allows limited horizontal displacement of the hinge blade bushing 30 with respect to the hinge pin 24, allowing the door panel 10 to move toward and away from the knife edge 15 on the door frame 14, when the door panel 10 is being dogged and undogged.

As shown in FIG. 5, the cylindrical body portion 38 of the hinge blade bushing 30 is inserted into the hinge blade 28, while the bushing flange portion 37 is axially spaced by the washers 32 from the flange portion of the bushing 34 inserted into the lower hinge pad 22. The washers 32 effectively position the adjusted height of the door panel 10 so that its horizontal axis intersects the hinge axis 25 perpendicular thereto. The flange portion of the washer 36 underlies the pin head 26 which is thereby positioned on the upper hinge pad 20 after the washer 36 is inserted into the upper hinge pad 20.

As a result of the use of the hinge assemblies 16 as hereinbefore described for pivotal support of the door panel 10, the number of parts associated therewith is substantially reduced for easier and less costly replacement by personnel with minimal experience or training. Additionally the hinge assemblies 16 eliminate side movement and off-center positioning of the door panel 10 as well as avoiding chafing between the door panel 10 and the door frame knife-edge 15.

Obviously, other modifications and variations of the present invention may be possible in light of the foregoing teachings. It is therefore to be understood that within the scope of the appended claims the invention may be practiced otherwise than as specifically described.

What is claimed is:

1. A watertight sealing arrangement having a door panel, a door wall, and a door frame attached to the door wall, the door frame encompassing an opening formed in the wall to be closed by the door panel, a hinge assembly pivotally supporting the door panel on the door frame comprising: upper and lower hinge pads fixed to the door frame in vertically spaced relation to each other; a hinge blade fixed to the door panel and extending horizontally therefrom between the vertically spaced hinge pads; a hinge pin supported on the upper hinge pad and extending downwardly therefrom along a vertical axis through the hinge blade and through the lower hinge pad; and a bushing arrangement positioned within the hinge blade for guiding angular displacement of the door panel about the vertical axis of the hinge pin to a position closing the door wall opening while allowing limited horizontal displacement relative to the hinge pin, wherein the bushing arrangement comprises a bottom flange supported on the lower hinge pad and a cylindrical body portion extending vertically upwardly from the bottom flange into the hinge blade, and spacing washers positioned on the hinge pin between the bottom flange and the lower hinge pad, the cylindrical body portion of the bushing arrangement having a slot hole through which the hinge pin extends, the slot hole being elongated in a horizontal direction to accommodate the limited horizontal displacement of the bushing arrangement relative to the hinge pin, the watertight sealing arrangement further comprising a substantially U-shaped channel attached to the door panel, a gasket affixed inside the substantially U-shaped channel, a knife edge formed on the door frame, wherein when the door panel is angularly displaced to close the wall opening, the knife edge is in pressing contact with the gasket establishing the watertight seal, wherein the knife edge is positioned such that the horizontal displacement of the bushing arrangement relative to the hinge pin moves the door panel towards and away from the knife edge, wherein in the bushing arrangement, the diameter of the bottom flange is greater than the diameter of the cylindrical body portion, and wherein the hinge blade is supported on the bottom flange, the bottom flange being sandwiched between the hinge blade and the spacing washers, wherein each of the bottom flange and the cylindrical body portion are circular, and wherein the upper hinge pad and the bushing arrangement are vertically spaced apart with no washer therebetween, to enable the adjustment of the height of the door panel.

* * * * *